US006705890B2

(12) United States Patent
Kitou et al.

(10) Patent No.: US 6,705,890 B2
(45) Date of Patent: Mar. 16, 2004

(54) ELECTRONIC EQUIPMENT WITH CONNECTOR HOUSING STRUCTURE

(75) Inventors: Masaaki Kitou, Tokushima (JP); Tokumi Baba, Tokushima (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 238 days.

(21) Appl. No.: 10/042,012

(22) Filed: Oct. 25, 2001

(65) Prior Publication Data

US 2002/0168891 A1 Nov. 14, 2002

(30) Foreign Application Priority Data

Oct. 25, 2000 (JP) ..... 2000-324784

(51) Int. Cl.[7] ..... H01R 13/60
(52) U.S. Cl. ..... 439/528; 439/501; 439/160
(58) Field of Search ..... 439/159, 160, 439/501, 528, 352, 357

(56) References Cited

U.S. PATENT DOCUMENTS 6,224,405 B1 * 5/2001 Eland ..... 439/160
6,386,908 B2 * 5/2002 Kato et al. ..... 439/528

FOREIGN PATENT DOCUMENTS

| | | |
|---|---|---|
| JP | 2000-010657 | 1/2000 |
| JP | 2000-172377 | 6/2000 |
| JP | 2000-332434 | 11/2000 |

* cited by examiner

*Primary Examiner*—Khiem Nguyen
(74) *Attorney, Agent, or Firm*—RatnerPrestia

(57) ABSTRACT

Electronic equipment with a connector housing structure comprises a groove and a recess on the lateral side of the main body for housing a cable with a connector. The electronic equipment main body enables the cable and the connector to be housed without protruding from the main body, and further makes it easy to insert and remove the connector from the main body.

10 Claims, 5 Drawing Sheets

ELECTRONIC EQUIPMENT WITH CONNECTOR HOUSING STRUCTURE

FIELD OF THE INVENTION

The present invention relates to electronic equipment with a connector housing structure. The connector housing structure comprises a connector for connecting with other external equipment and a cable for connecting the connector with a main body of the electronic equipment. The connector and the cable are housed in the main body of the electronic equipment.

BACKGROUND OF THE INVENTION

Electronic equipment that communicates with a further apparatus (e.g., a personal computer, a word processor, etc.)comprises a connector for connecting with the further apparatus, and a flexible cable for connecting the connector with a main body of the electronic equipment.

Conventionally, several types of electronic equipment that enable the connector and the cable to be housed in a main-body of electronic equipment have been proposed.

For example, JP Patent Publication No. H04-088700 describes electronic equipment that is convenient for a user, wherein the main body binds the connecting cable inside and houses a connecting plug connected to a cable. Thus, the user can utilize a suitable length of the cable while using and house the connecting plug and cable in the front panel during non-use.

JP Patent Publication No. 2000-010657 discloses portable electronic equipment that comprises a main body housing an electronic equipment portion, a cover for the main body, a groove housing a cable from the inside part of the main body, and a recess housing a connector. The cable and connector are housed in the groove and the recess respectively, when not in use.

The prior art, however, has drawbacks. In the first example, a cable binding may be complicated and expensive. In the second example, the cover must be opened to house the connector and the cable.

SUMMARY OF THE INVENTION

Electronic equipment with a connector housing structure includes a cable extending from a cable opening provided on a lateral side of an electronic equipment main body, a connector which is connected to an end of the cable, a groove portion formed on a lateral side of the main body in succession to the cable opening for housing the cable, and a recess provided on the lateral side of the main body immediately adjacent to the groove. The electronic equipment houses the cable and the connector in main body so that the cable does not protrude from the electronic equipment main body.

DETAILED DESCRIPTION OF THE INVENTION

An exemplary embodiment of the present invention is hereinafter demonstrated with reference to the accompanying drawings.

Figure 1:
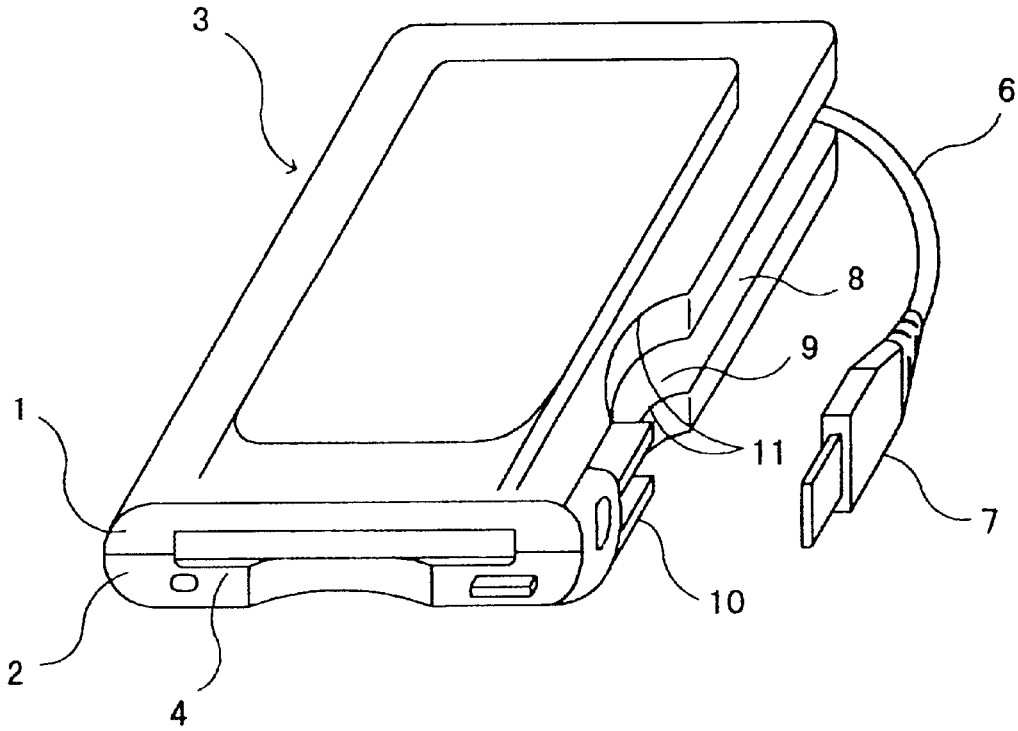
FIG. 1 is a perspective view of electronic equipment with a connector housing structure in an exemplary embodiment of the present invention.
Figure 2:
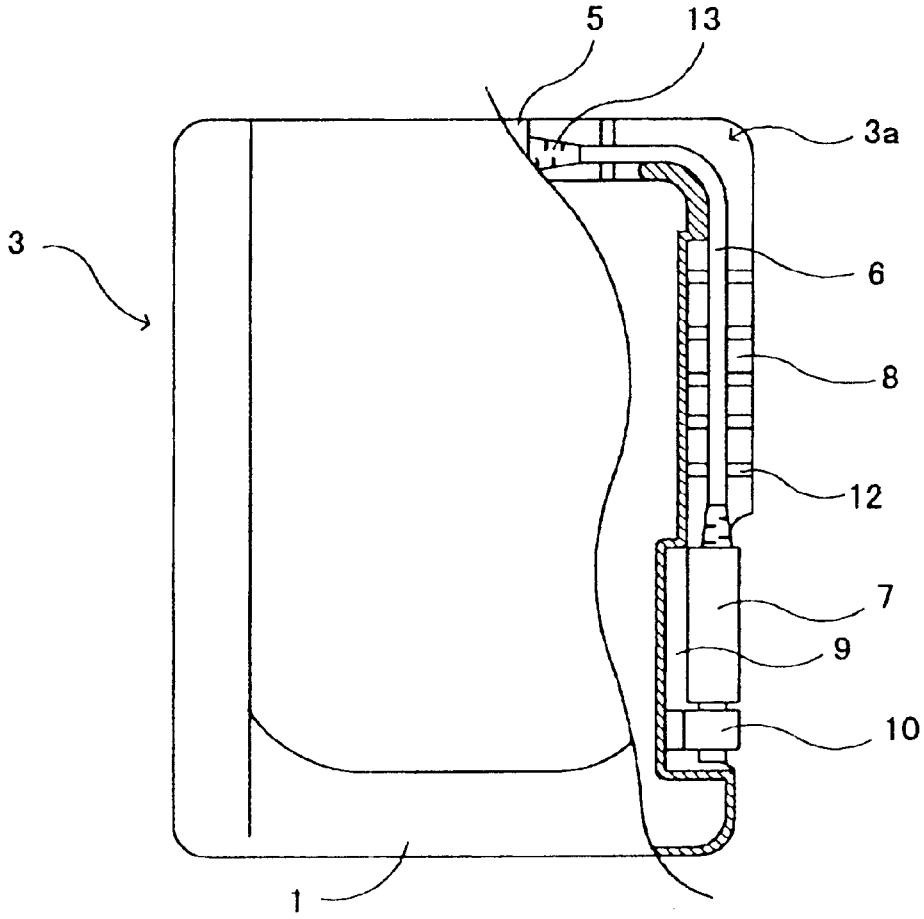
FIG. 2 is a partially cutaway cross-sectional view depicting the electronic equipment of FIG. 1 when not in use.

As shown in FIGS. 1 and 2, a main body 3 has a top cover 1 and a bottom cover 2 for covering an electronic circuitry portion (not illustrated in the drawings). The top cover 1 and the bottom cover 2 have planar surface and each cover is formed by plastic mold respectively. The main body 3 has t thin rectangular solid shape. The main body 3 provides an operation portion 4 in the front surface, and a cable opening 5 for extending a cable 6 in the rear portion. The cable 6 extending from the cable opening 5 is connected with a connector 7 at the end, which is used for connecting the electronic equipment with an external device. In succession to the cable opening 5, a groove portion 8 for housing the cable 6 is formed on a lateral side of the main body 3 of the electronic equipment. A recess 9 for housing the connector 7 is provided immediately adjacent at the end of the groove portion 8 on the lateral side of the main body 3.

Figure 4:
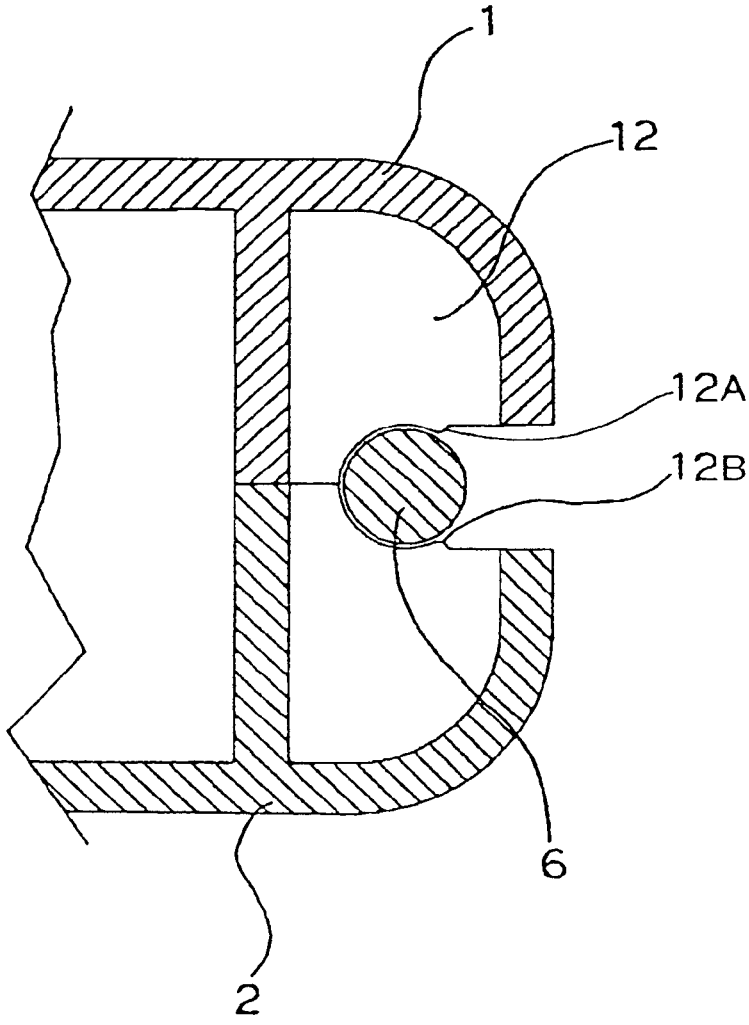
FIG. 4 is a cross-sectional side view depicting a cable of the electronic equipment housed in a groove.

As shown in FIGS. 2 and 4, catch plates 12 are provided in the groove s portion 8 at certain intervals. Each catch plate forms projections 12A on the top cover side and 12B on the bottom cover side. With the projections 12A and 12B, catch plates catch the cable 6 so that the cable is engagedly held.

As shown in FIG. 2, the cable opening 5 for extending the cable 6 is provided on a recessed part in rear portion of the main body 3, and a buffering material 13 which is made by rubber is provided for buffering a stress acting on the cable 6 and the cable opening 5. As to the groove portion 8 of the corner portion formed on the corner 3*a* of the main body 3, the groove is deeper than other portions, and is formed to be a curved shape more than the allowable bending radius of the cable 6 to avoid adding unreasonable stress to the cable 6. Also, the groove portion 8 including the corner portion 3*a* has enough depth that the cable 6 does not protrude from the main body's periphery even when the cable 6 is loosened.

Figure 3:
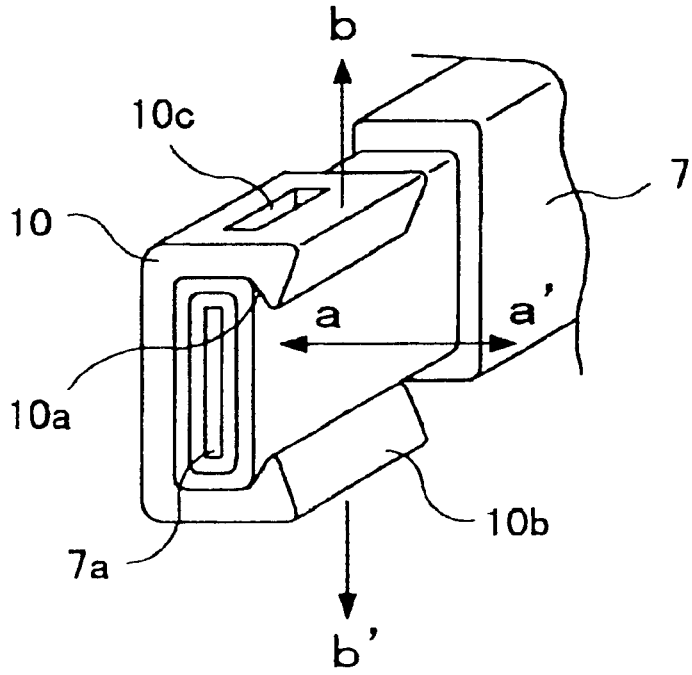
FIG. 3 is a perspective view depicting the connector of the electronic equipment fastened in a chuck.

As shown in FIGS. 1 and 3, a connector fastening chuck 10 is provided in the recess 9 as a holding means for detachably holding the connector 7 together. Connecting part 7*a* of the connector 7 to connect the electronic equipment with an external device is made of metal. On the other hand, the connecter fastening chuck 10 is made of an elastic material. In FIG. 3, the connector fastening chuck 10 has a square shape in a U-like configuration when viewed from the front, and inclined planes 10*a* and 10*b* are formed on the connector fastening chuck 10 for guiding insertion of the connecting part 7*a* when the connector 7 is housed. When the connector 7 is moved in the a–a' direction for housing or releasing the connector 7, guiding portion of the connector fastening chuck 10 moves in the b–b' direction so that the connector 7 is fixed or released easily and securely.

Further, the connector fastening chuck 10 has a groove 10*c* in both the top and bottom sides for engaging with a rib (not illustrated in the drawing) provided in both the top cover 1 and the bottom cover 2 respectively in order to fix the connector fastening chuck 10.

On the sidewall of the recess 9, concretely on the top cover 1 and the bottom cover 2 at the recess 9, cutaway portions 11 beyond a finger width are provided. The cutaway portions 11 have an arc like shape. As for the shape of the cutaway portion 11, any shape such as a rectangular shape, a U-shape, or a curved shape, may also be used if it is easy for the user to insert his fingers into the cutaway portion 11 to grasp the connector 7. When the connector 7 is housed in the recess 9, both side surfaces of the connector 7 are exposed from the cutaway portions. And when the connector 7 is to be released, fingers inserted into the cutaway portion 11 can easily grasp the side surfaces of the connector 7 and release the connector 7 from the connector fastening chuck 10. Release of the cable 6 from the groove portion 8 follows the release of the connector 7. Thus, connecting with other equipment is easily established by releasing the connector 7 from the connector fastening chuck 10, and then connecting with the other electronic equipment.

The connector 7 is securely held by the connector fastening chuck 10 by pressing the connector 7 toward the connector fastening chuck 10. With this structure, the connector 7 is easily detachable from the recess 9 by inserting fingers into the cutaway portion 11 and grasping the connector 7.

In addition, the entire length of the groove portion 8 is substantially equivalent to the length of the cable 6. With these structures, even if the length of the cable 6 has dispersion or the cable 6 is loosened, the cable 6 is housed in the groove portion 8 without protruding from the periphery of the electronic equipment 3 along with the groove portion. In addition, the cable 6 can be housed by only housing the connector 7 without holding the cable 6. In other words, when connecting or disconnecting the electronic equipment 3 with other electronic equipment, housing and connecting motion can be performed by handling only the connector 7. Thus, this structure is reasonable and simple in operation.

Further more, in FIG. 2, the cable 6 and the connector 7 are placed on the right side of the operation portion 4. However, the connector 7 may be placed on the left side of the operation portion 4 by turning the electronic equipment upside down, since the design of the top and bottom is substantially identical and both sides have substantially planar surfaces. Therefore, whether the connector location of an external electronic equipment is right or left, connection between the electronic equipment 3 and the external equipment can be easily made.

Figure 5:
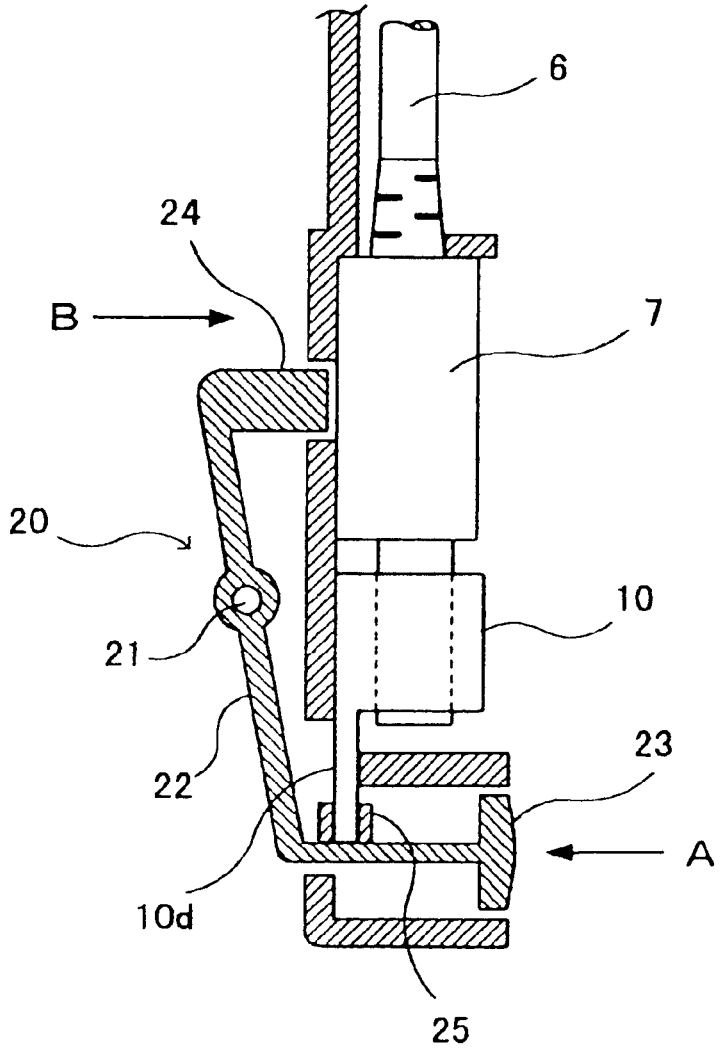
FIG. 5 is a cross-sectional view depicting a pushing means for removing the connector from a recess.

A pushing means 20 may be provided for releasing the connector 7 from the connector fastening chuck 10 as shown in FIG. 5. This pushing means 20 includes a rotation fulcrum 21, a rotation lever 22, a push button 23, a pressure knob 24 and an engaging portion 25. The rotation lever 22 pivots on the rotation fulcrum 21. On an end of the rotation lever 22, the push button 23 which can be pushed by a finger is formed, and on the other end the pressure knob 24 is also formed for pushing out the connector 7 fastened to the connector fastening chuck 10 from inside to outside. The engaging portion 25 is engaged with a hinge portion 10*d* which is unitedly formed with the connector fastening chuck 10 at the depth side of the pushing button 23.

When the pushing button 23 is pressed to the direction of the arrow A, the rotation lever 22 moves around the rotation fulcrum 21 elastically deforming the hinge 10*d* of the connector fastening chuck 10. As a result, pressure knob 24 moves toward the direction of the arrow B and extrude the connector 7. When release of the connector 7 is completed, the rotation lever 22, the pushing button 23 and the pressure knob 24 return to their predetermined location by elasticity of the hinge portion 10*d*.

Herewith, when connecting the electronic equipment 3 with an external device, the connector 7 can be easily released from the recess 9 by only pushing the pushing button 23, and operationality becomes better.

As described above, according to the present invention, the structure that cable 6 and the connector 7 are housed into the groove 8 and the recess 9 provided on the lateral side of the electronic equipment main body 3 enables easy detachability. Also, a cable reel mechanism is not required. Thus, production cost for producing the electronic equipment is less than the electronic equipment which uses the cable reel mechanism.

In this example, the present invention is described using external data storage electronic equipment capable of storing external data into the electronic equipment. The electronic equipment, however, is not limited to the above and the connector housing structure of this invention can be attached to other electronic equipment.

What is claimed is:

1. Electronic equipment with a connector housing structure comprising:

(a) a cable extending from a cable opening provided on a main body of said electronic equipment;

(b) a connector which is connected to said cable;

(c) a groove portion for housing said cable formed on a lateral side of said main body;

(d) a recess provided on the lateral side of said main body;

(e) holding means for holding said connector in said recess; and (f) a cutaway portion provided on a sidewall of said recess, so that said connector housed in said recess is exposed at said cutaway portion.

2. Electronic equipment with a connector housing structure comprising:

(a) a cable extending from a cable opening provided on a main body of said electronic equipment;

(b) a connector which is connected to said cable;

(c) a groove portion for housing said cable formed on a lateral side of said main body so that said cable does not protrude from said main body when said cable and said connector are housed in said electronic equipment;

(d) a plurality of catch plates spaced along the groove for holding the cable, each of said catch plates forming a first projection on a top cover of the main body and a second projection on a bottom cover of the main body; and (e) a recess for housing said connector provided on the lateral side of said main body of said electronic equipment.

3. Electronic equipment with a connector housing structure according to claim 1 further comprising:

pushing means for pushing said connector out of said holding means.

4. Electronic equipment with a connector housing structure according to claim 2 further comprising:

pushing means for pushing said connector out of said holding means.

5. Electronic equipment with a connector housing structure according to claim 2, wherein an entire length of said groove for housing said cable is substantially equivalent to a length of said cable.

6. Electronic equipment with a connector housing structure according to claim 1, wherein a corner portion of said groove for housing cable is deeper than other portions of said groove and has a curved shape.

7. Electronic equipment with a connector housing structure according to claim 1, wherein top and bottom covers of said electronic equipment are substantially identical.

8. Electronic equipment with a connector housing structure according to claim 1, wherein a top cover of said electronic equipment has a substantially planar surface.

9. Electronic equipment with a connector housing structure according to claim 4, wherein an entire length of said groove for housing said cable is substantially equivalent to a length of said cable.

10. Electronic equipment with a connector housing structure comprising:

(a) a cable extending from a cable opening provided on a main body of said electronic equipment;

(b) a connector which is connected to said cable;

(c) a groove portion formed on a lateral side of said main body for housing said cable;

(d) a plurality of catch plates spaced along the groove for holding the cable, each of said catch plates forming a first projection on a top cover of the main body and a second projection on a bottom cover of the main body; and (e) a recess provided on the lateral side of said main body.

* * * * *